US009702545B2

(12) United States Patent
Matsumoto et al.

(10) Patent No.: US 9,702,545 B2
(45) Date of Patent: Jul. 11, 2017

(54) OIL-FIRED BURNER, SOLID FUEL-FIRED BURNER UNIT, AND SOLID FUEL-FIRED BOILER

(71) Applicant: MITSUBISHI HEAVY INDUSTRIES, LTD., Tokyo (JP)

(72) Inventors: Keigo Matsumoto, Tokyo (JP); Kazuhiro Domoto, Tokyo (JP); Naofumi Abe, Tokyo (JP); Jun Kasai, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 297 days.

(21) Appl. No.: 14/357,612

(22) PCT Filed: Oct. 31, 2012

(86) PCT No.: PCT/JP2012/078121
§ 371 (c)(1),
(2) Date: May 12, 2014

(87) PCT Pub. No.: WO2013/073366
PCT Pub. Date: May 23, 2013

(65) Prior Publication Data

US 2014/0356795 A1 Dec. 4, 2014

(30) Foreign Application Priority Data

Nov. 16, 2011 (JP) ..... 2011-250964

(51) Int. Cl.
*F23C 1/10* (2006.01)
*F23D 11/24* (2006.01)
(Continued)

(52) U.S. Cl.
CPC ..... *F23C 1/10* (2013.01); *F23C 5/00* (2013.01); *F23C 5/12* (2013.01); *F23C 5/32* (2013.01);
(Continued)

(58) Field of Classification Search
CPC ..... F23C 1/10; F23C 5/00; F23C 5/32; F23C 5/12; F23D 11/24; F23D 1/005; F23D 11/38
See application file for complete search history.

(56) References Cited

U.S. PATENT DOCUMENTS 3,123,027 A 3/1964 Livingston
3,224,419 A 12/1965 Lowenstein et al.
(Continued)

FOREIGN PATENT DOCUMENTS

CN 1110880 A 10/1995
CN 2252938 Y 4/1997
(Continued)

OTHER PUBLICATIONS

International Search Report, dated Jan. 29, 2013, issued in corresponding application No. PCT/JP2012/078121.
(Continued)

*Primary Examiner* — Alfred Basichas
(74) *Attorney, Agent, or Firm* — Westerman, Hattori, Daniels & Adrian, LLP

(57) ABSTRACT

An oil-fired burner (30A) for warming, disposed adjacent to the outer periphery of a pulverized coal burner which inputs pulverized coal and air into a furnace, includes: an oil gun (32) for inputting an oil fuel disposed at the center of an outlet opening of a nozzle main body (31) substantially rectangular in cross-section; and a secondary air input port (40) disposed so as to surround the outer periphery of the oil gun (32), wherein the secondary air input port (40) is
(Continued)

constituted of: a central arc section (41) substantially similar in shape to a circular diffuser (34) mounted on the leading end side of the oil gun (32); and rectangular sections (42L, 42R) provided continuously from both sides of the central arc section (41) and narrowed in face-to-face dimension in the direction of the adjacent pulverized coal burners so as to increase the distance from them.

3 Claims, 6 Drawing Sheets

(51) Int. Cl.

| | |
|---|---|
| ***F23C 5/00*** | (2006.01) |
| ***F23C 5/08*** | (2006.01) |
| ***F23C 5/32*** | (2006.01) |
| ***F23D 11/38*** | (2006.01) |
| ***F23D 1/00*** | (2006.01) |

(52) U.S. Cl.
CPC ..... *F23D 1/005* (2013.01); *F23D 11/24* (2013.01); *F23D 11/38* (2013.01)

(56) References Cited

U.S. PATENT DOCUMENTS

| | | | | |
|---|---|---|---|---|
| 3,285,319 | A | 11/1966 | Hartline | |
| 3,963,182 | A | 6/1976 | Rulseh | |
| 5,816,200 | A | 10/1998 | Mann et al. | |
| 5,829,367 | A | 11/1998 | Ohta et al. | |
| 5,937,770 | A | 8/1999 | Kobayashi et al. | |
| 6,715,432 | B2 * | 4/2004 | Tsumura ..... | F23C 5/32 110/261 |

FOREIGN PATENT DOCUMENTS

| | | | |
|---|---|---|---|
| CN | 1243216 | A | 2/2000 |
| CN | 2371445 | Y | 3/2000 |
| CN | 101124433 | A | 2/2008 |
| CN | 201093488 | Y | 7/2008 |
| CN | 101603683 | A | 12/2009 |
| CN | 201688440 | U | 12/2010 |
| EP | 0 160 134 | A1 | 11/1985 |
| EP | 0554254 | B1 | 8/1996 |
| JP | 39-11303 | B1 | 6/1964 |
| JP | 08-135919 | A | 5/1996 |
| JP | 08-226615 | A | 9/1996 |
| JP | 8-296815 | A | 11/1996 |
| JP | 08-296822 | A | 11/1996 |
| JP | 9-119606 | A | 5/1997 |
| JP | 09-203505 | A | 8/1997 |
| JP | 09-310809 | A | 12/1997 |
| JP | 9-329304 | A | 12/1997 |
| JP | 3021305 | B2 | 3/2000 |
| JP | 2000-111011 | A | 4/2000 |
| JP | 3679998 | B2 | 8/2005 |
| JP | 2010-091244 | A | 4/2010 |
| JP | 2010-270991 | A | 12/2010 |
| JP | 2011-220541 | A | 11/2011 |
| TW | 187180 | | 7/1992 |
| TW | 358149 | | 5/1999 |
| WO | 2009125566 | A1 | 10/2009 |
| WO | 2011/077762 | A1 | 6/2011 |

OTHER PUBLICATIONS

Notification of Grant of Invention Patent dated Dec. 24, 2015, issued in counterpart Chinese Application No. 201280055936.3. With English translation. Concise statement of relevance: "The Notification of Grant of Invention Patent has been received." (4 pages).

Office Action dated Jun. 30, 2015, issued in counterpart Chinese Patent Application No. 201280055936.3, with English translation. (11 pages).

Decision to Grant a Patent dated Jun. 25, 2015, issued in counterpart Ukrainian Patent Application No. a2014 05084, with English translation. (11 pages).

Extended European Search Report dated May 7, 2015, issued in corresponding European Patent Application No. 12848949.9 (6 pages).

Notice of Allowance dated Apr. 15, 2015, issued in corresponding Taiwanese Patent Application No. 101142210 (2 pages).

Japanese Decision to Grant a Patent dated Nov. 4, 2014, issued in corresponding Japanese Application No. 2011-250964; w/English Translation. (6 pages).

Office Action dated Nov. 24, 2014, issued in corresponding Taiwanese Patent Application No. 101142210, with English Translation (8 pages).

Written Opinion dated Jan. 29, 2013, issued in PCT/JP2012/078121 with English Translation (6 pages).

Notice of Allowance dated Oct. 27, 2015, issued in corresponding Korean Patent Application No. 2014-7012942 (2 pages).

Decision of Patent Grant dated Sep. 29, 2016, issued in corresponding Japanese Patent Application No. 2014-238810, with English translation. (7 pages).

Notice of Allowance dated Jul. 11, 2016, issued in counterpart Thai Application No. 1401002604. (1 page). Explanation of Relevance—"The Notice of Allowance has been received."

Office Action dated Feb. 15, 2017 issued in counterpart Chilean Patent Application No. 2014-01165. (11 pages).

Mexican Notice of Allowance dated Feb. 2, 2017, issued in counterpart application No. MX/a/2014/005775. (1 page). Concise explanation of relevance: The Notice of Allowance has been received.

* cited by examiner

OIL-FIRED BURNER, SOLID FUEL-FIRED BURNER UNIT, AND SOLID FUEL-FIRED BOILER

TECHNICAL FIELD

The present invention relates to an oil-fired burner for warming applied to a boiler equipped with a solid fuel-fired burner which burns a solid fuel (pulverized fuel) such as pulverized coal, a solid fuel-fired burner unit equipped with this oil-fired burner, and a solid fuel-fired boiler.

BACKGROUND ART

Conventional solid fuel-fired boilers include, for example, a pulverized coal-fired boiler which burns pulverized coal (coal) as a solid fuel. There are two types of known firing systems in such a pulverized coal-fired boiler: a circulating firing boiler and an opposed firing boiler, both of which require warming-up operation before combusting a solid fuel.

Of these systems, the circulating firing boiler has oil-fired burners for boiler warming installed above and below a pulverized coal burner (e.g., see PTL 1).

The above-mentioned oil-fired burner is, for example, as in the configuration example shown in FIG. 5, arranged in the order of a secondary air input port 51, an oil-fired burner 30, a pulverized coal burner 52, an oil-fired burner 30 . . . a pulverized coal burner 52, and an auxiliary air input port 53, from the upper stage in the front view of a wind box 50 taken from the inside of a furnace. Thus, multiple pairs of the oil-fired burner 30 and the pulverized coal burner 52 are combined in the vertical direction to serve as an integrated unit which is continuous in the height direction of the furnace.

The above-mentioned oil-fired burner 30 has, for example, as shown in FIG. 6, a rectangular leading end of a nozzle main body 31 (rectangular cross-section of the main body) when viewed from the inside of the furnace, and a nozzle tip 32*a* of an oil gun 32 for inputting fuel oil by injection is disposed at the center of an outlet opening. Inside the nozzle main body 31, a secondary air input port (nozzle) 33 is provided so as to surround the outer periphery of the nozzle tip 32*a* which is substantially circular in cross-section. This secondary air input port 33 has a rectangular shape which is substantially the same as the shape of the leading end of the nozzle main body 31, but is somewhat reduced in the vertical direction so as to be somewhat smaller in opening area than the nozzle main body 31.

Reference numeral 34 of FIG. 6 denotes a substantially conical diffuser which is formed around the nozzle tip 32*a*, and a cylindrical ignition air passage 35 is provided so as to surround the outer periphery of the diffuser 34.

CITATION LIST

Patent Literature

{PTL 1}

Japanese Unexamined Patent Application, Publication No. 2010-91244.

SUMMARY OF INVENTION

Technical Problem

In the above-described structure of the conventional pulverized coal burner, since the oil-fired burners are installed immediately above and below the pulverized coal burner, only secondary air is input from the oil-fired burners when pulverized coal is combusted by the pulverized coal burner after completion of boiler warming. That is, in the oil-fired burner after completion of warming, only the fuel oil injection is stopped while the secondary air is continuously input during combustion of pulverized coal.

Therefore, this secondary air is diffused toward the outer periphery of the flame of the combusting pulverized coal input from the pulverized coal burner and is quickly supplied to the flame.

As a result, a high-temperature oxygen remaining region (high-temperature high-oxygen region) is created on the outer periphery of the flame near the oil-fired burner during combustion of pulverized coal, and especially in the region where the secondary air concentrates, the high-temperature oxygen remaining region becomes dominant, contributing to an increase in NOx generation.

On the other hand, if the secondary air input port 33 of the oil-fired burner is designed to be smaller, air is not sufficiently supplied to the space surrounding the diffuser installed at the center of the opening, which can lead to generation of smoke due to insufficient air during warming, etc. at the start-up of the boiler.

Especially, when a diffuser-type oil-fired burner is adopted, the secondary air input from the oil-fired burner is kicked by the diffuser outward in the flow direction of the pulverized coal and diffused to directly act on the flow of the pulverized coal input from the adjacent pulverized coal burner, thus contributing to creation of the high-temperature oxygen remaining region on the outer periphery of the flame. That is, in the pulverized coal burner, ignition occurs on the outer periphery of the flame, and a large amount of air is mixed on the outer periphery of the flame, so that combustion on the outer periphery of the flame proceeds under high temperature with a high concentration of oxygen in the high-temperature oxygen remaining region on the outer periphery of the flame. Thus, NOx is generated on the outer periphery of the flame.

Since this NOx generated in the high-temperature oxygen remaining region on the outer periphery of the flame passes through the outer periphery of the flame, it undergoes reduction with a delay compared with the NOx generated inside the flame, which contributes to NOx generation from the coal-fired boiler.

Given such background, it is desirable in a solid fuel-fired burner equipped with an oil-fired burner, to prevent or suppress the phenomenon of the secondary air input from the oil-fired burner being diffused toward the outer periphery of the flame formed by combustion of pulverized coal and being quickly and directly supplied to the outer periphery of the flame. On the other hand, during warming when fuel oil is combusted by the oil-fired burner, it is required to secure the oil combustion performance so as not to cause generation of smoke due to insufficient air, etc.

The present invention has been made in order to solve the above problems, and an object thereof is to provide an oil-fired burner, which can secure the combustion performance in oil combustion as well as prevent or suppress the phenomenon of the secondary air input from the oil-fired burner being quickly diffused toward the outer periphery of the flame during combustion of a solid fuel such as pulverized coal, a solid fuel-fired burner unit equipped with this oil-fired burner, and a solid fuel-fired boiler.

Solution to Problem

In order to solve the above problems, the present invention has adopted the following solutions.

An oil-fired burner according to a first aspect of the present invention is an oil-fired burner for warming which is disposed adjacent to an outer periphery of a solid fuel-fired burner which inputs a pulverized fuel and air into a furnace. The oil-fired burner includes: an oil gun for inputting an oil fuel disposed at a center of an outlet opening of a nozzle main body which is substantially rectangular in cross-section; and a secondary air input port provided so as to surround an outer periphery of the oil gun, wherein the secondary air input port is constituted of: a central arc section which is substantially similar in shape to a circular diffuser mounted on a leading end side of the oil gun; and rectangular sections which are provided continuously from both sides of the central arc section and which are narrowed in face-to-face dimension in the direction of the adjacent solid fuel burners so as to increase the distance from the adjacent solid fuel burners.

The oil-fired burner according to the first aspect includes: the oil gun for oil fuel injection disposed at the center of the outlet opening of the nozzle main body which is substantially rectangular in cross-section; and the secondary air input port provided so as to surround the outer periphery of the oil gun, and the secondary air input port is constituted of: the central arc section which is substantially similar in shape to the circular diffuser mounted on the leading end side of the oil gun; and the rectangular sections which are provided continuously from both sides of the central arc section and which are narrowed in face-to-face dimension in the direction of the adjacent solid fuel burners so as to increase the distance from the adjacent solid fuel burners. Thus, the central arc section of the secondary air input port is formed so as to encircle the circular diffuser from a position relatively close to the diffuser. Accordingly, sufficient secondary air is supplied to the diffuser during warming when fuel oil is combusted by the oil-fired burner. As a result, the oil combustion performance improves, and generation of smoke, etc. due to insufficient air is less likely to occur.

In addition, since the secondary air input port is formed so as to encircle the diffuser, the secondary air input from this region covers the secondary air, which is kicked outward by the diffuser, so that it does not flow toward the flame of the solid fuel-fired burner.

Moreover, since the rectangular sections of the secondary air input port are at a farther distance from the adjacent solid fuel burners, that is, since the width of the port except for the region surrounding the diffuser is minimized, the phenomenon of the secondary air being quickly diffused toward the outer periphery of the flame formed by combustion of the solid fuel can be prevented or suppressed.

A solid fuel-fired burner unit according to a second aspect of the present invention includes: a wind box; at least one oil-fired burner disposed inside the wind box at a center position in a vertical direction; solid fuel-fired burners which input a pulverized fuel and air into a furnace; and secondary air input ports which are installed inside the wind box at upper and lower ends so as to be located above and below the solid fuel-fired burners and which supply secondary air to the solid fuel-fired burners, wherein the oil-fired burner and the solid fuel-fired burners are alternately disposed in a vertical direction so that the solid fuel-fired burners are located above and below the oil-fired burner.

According to this solid fuel-fired burner unit, it is possible to configure a burner unit in which one oil-fired burner, two solid fuel-fired burners, and a pair of upper and lower secondary air input ports are housed in the wind box, or another burner unit in which multiple oil-fired burners, multiple solid fuel-fired burners, and a pair of upper and lower secondary air input ports are housed in the wind box. In particular, it is possible to dispose a required number of solid fuel-fired burner units on top of one another by adopting a unit structure with a small number of the oil-fired burners installed inside the wind box, and it is also possible to enhance the strength of the boiler main body by applying a divided wind box system in which a furnace wall is provided between the units.

In this case, it is desirable that the secondary air input ports are installed toward the directions away from each other in the vertical direction. This way, creation of the high-temperature high-oxygen region on the outer periphery of the flame formed by combustion of the solid fuel can be suppressed or prevented, and moreover, the solid fuel-fired burner unit can be effectively reduced in size.

The secondary air input ports may be configured in multiple stages in order to increase the vertical distance between the solid fuel-fired burner units.

A solid fuel-fired boiler according to a third aspect of the present invention has the solid fuel-fired burner unit, which inputs a pulverized fuel and air into the furnace, at a corner or on a wall inside the furnace.

In this solid fuel-fired boiler, since it adopts the divided wind box system, the durability and the reliability are improved due to the enhanced strength of the boiler main body compared with a continuous wind box system which involves only one wind box continuous in the vertical direction.

Advantageous Effects of Invention

According to the above-described oil-fired burner of the present invention, it is possible to prevent or suppress the phenomenon of the secondary air input from the oil-fired burner being diffused toward the outer periphery of the flame formed by combustion of a solid fuel and being quickly and directly supplied to the outer periphery of the flame during combustion of the solid fuel such as pulverized coal.

On the other hand, during warming when fuel oil is combusted by the oil-fired burner, it is possible to secure the oil combustion performance by supplying a sufficient amount of air and thereby to prevent generation of smoke due to insufficient air, etc.

BRIEF DESCRIPTION OF DRAWINGS

FIG. 1(*a*) is a front view of the oil-fired burner and a solid fuel-fired burner taken from the inside of a furnace, and FIG. 1(*b*) is a longitudinal cross-sectional view of the oil-fired burner.

FIG. 6(*a*) is a front view taken from the inside of the furnace, and FIG. 6(*b*) is a longitudinal cross-sectional view of FIG. 6(*a*).

DESCRIPTION OF EMBODIMENTS

In the following, one embodiment of an oil-fired burner, solid fuel-fired burner unit, and a solid fuel-fired boiler according to the present invention will be described on the basis of the drawings. In this embodiment, although a solid fuel-fired burner (pulverized coal burner) fueled by pulverized coal (coal as a pulverized solid fuel) applied to a circulating firing boiler will be described as one example of the solid fuel-fired burner equipped with the oil-fired burner for warming, the present invention is not limited to this example.

Figure 2:
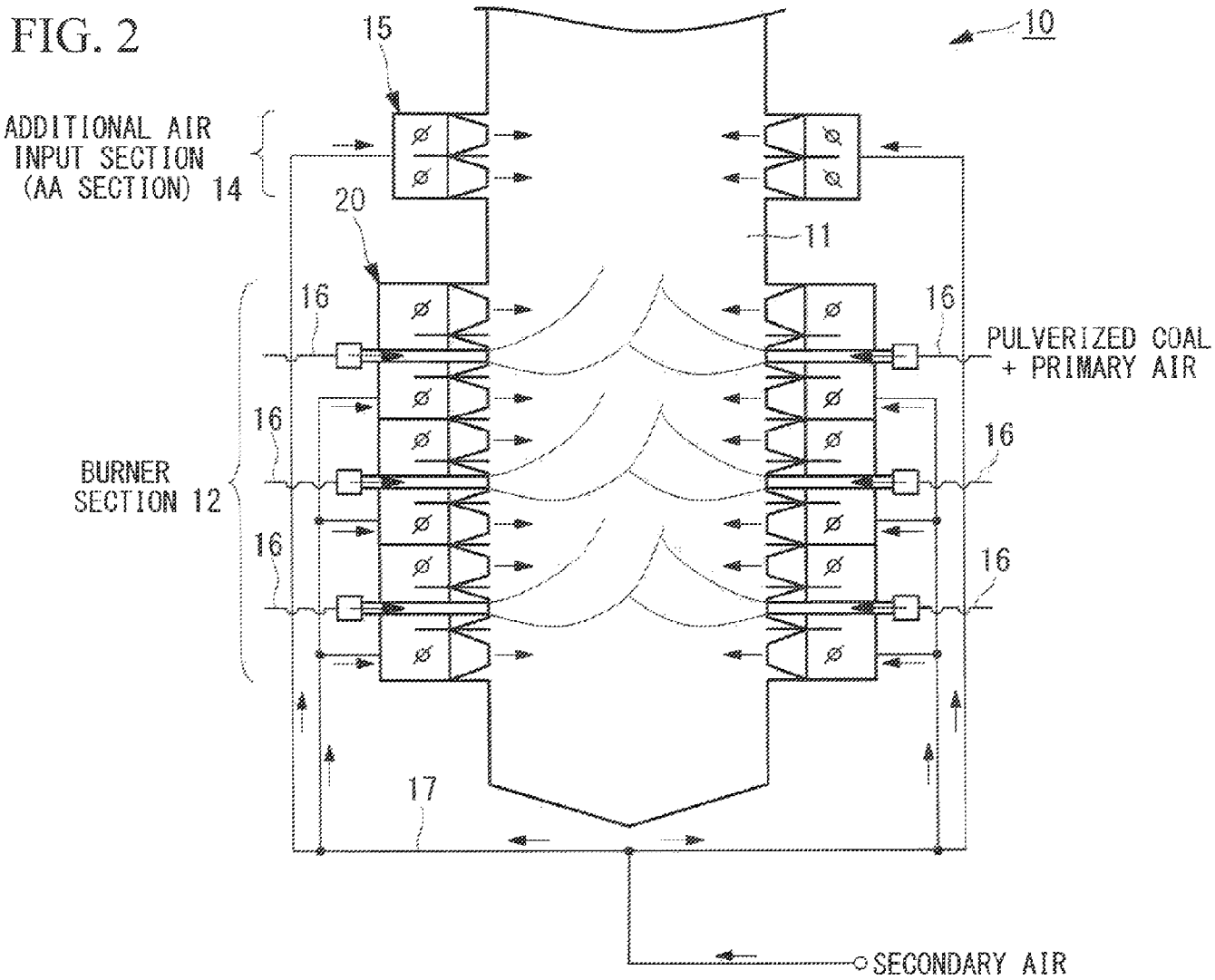
FIG. 2 is a longitudinal cross-sectional view showing a configuration example of a solid fuel-fired boiler (coal-fired boiler) according to the present invention.
Figure 3:
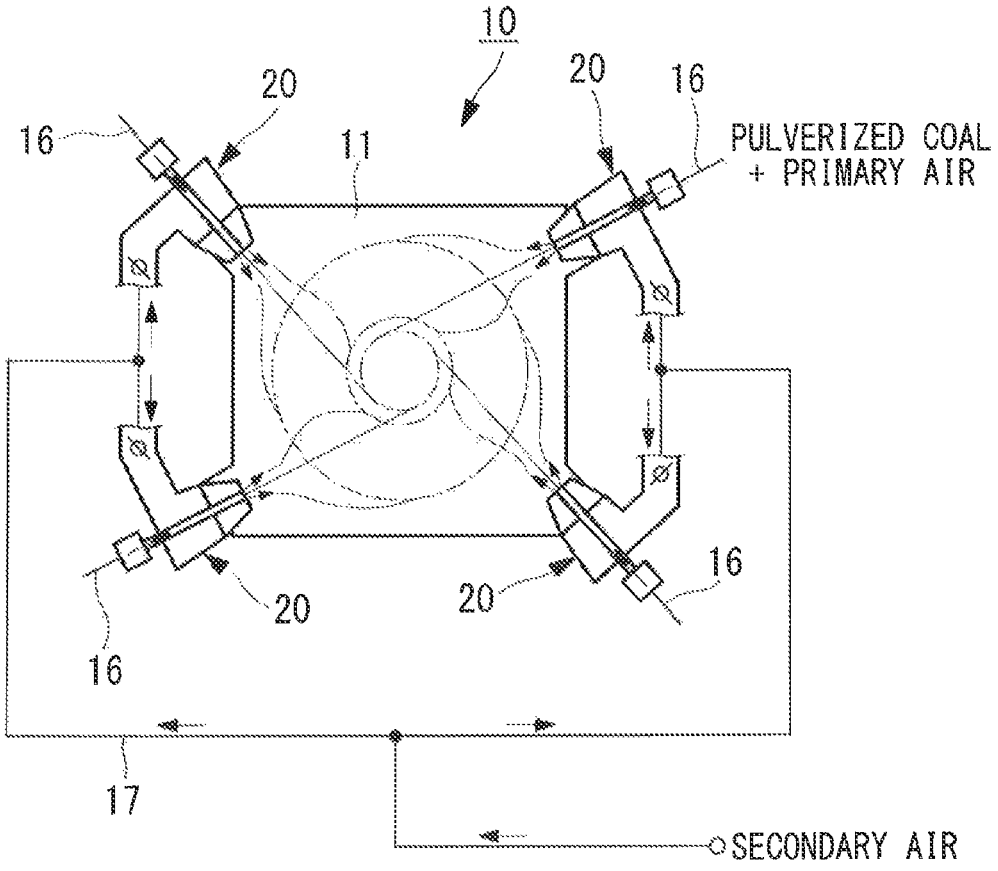
FIG. 3 is a transverse (horizontal) cross-sectional view of FIG. 2.
Figure 4:
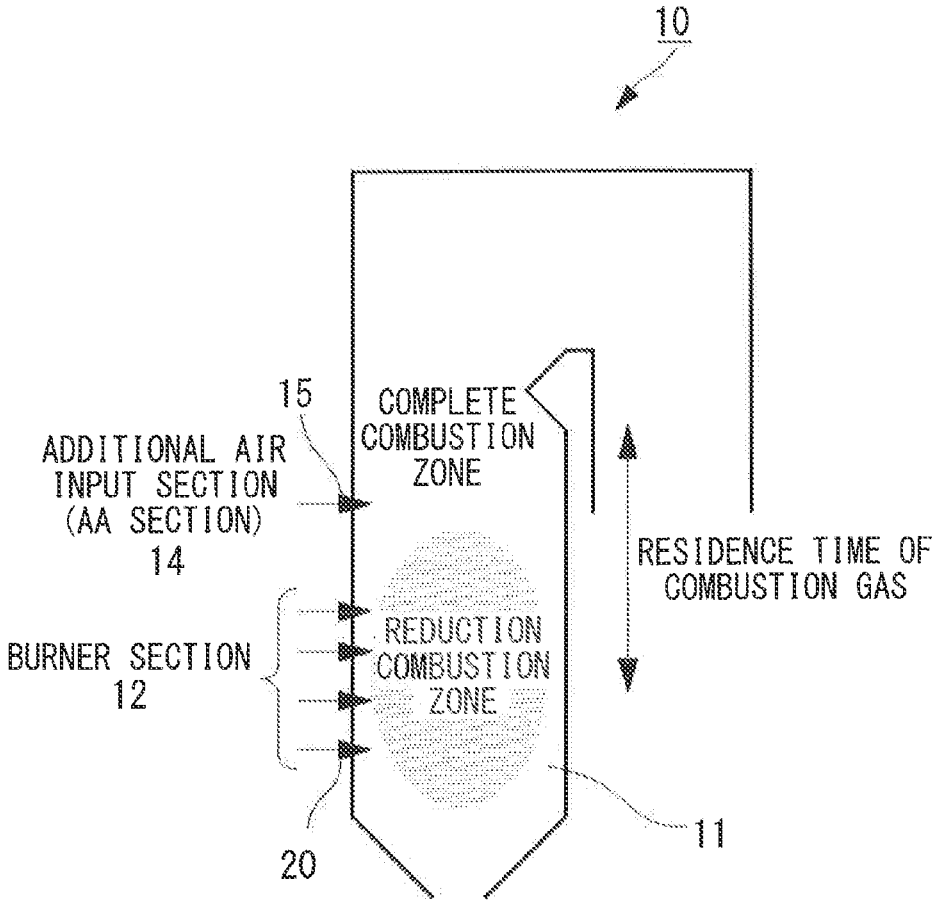
FIG. 4 is a diagram illustrating the outline of the solid fuel-fired boiler which is equipped with an additional air input section and inputs air in multiple stages.
Figure 5:
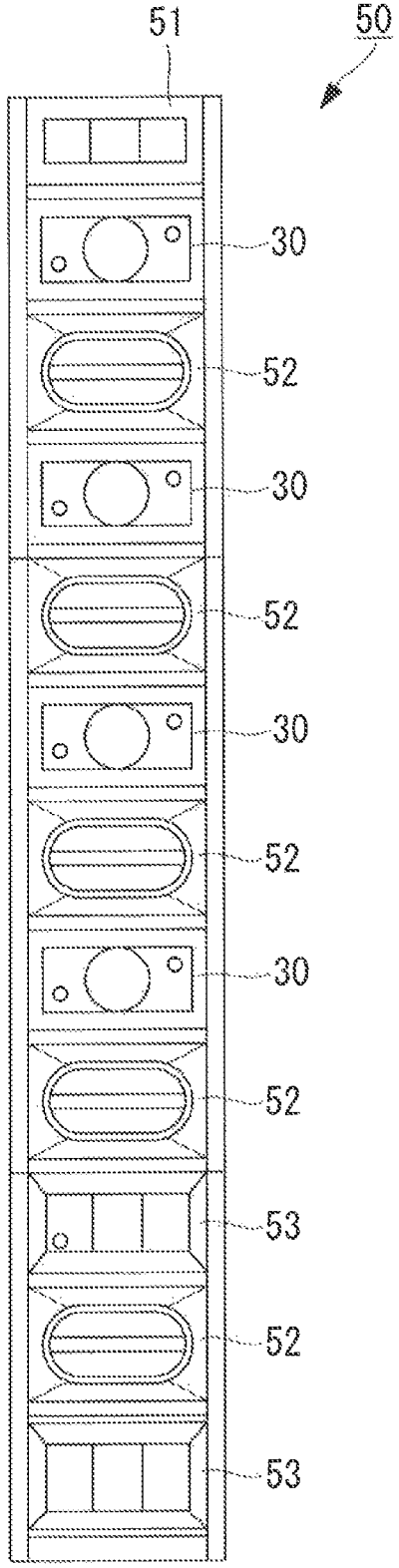
FIG. 5 is a front view of a configuration example of a continuous wind box system, regarding a solid fuel-fired burner equipped with conventional oil-fired burners, taken from the inside of the furnace.

A circulating firing boiler 10 shown in FIG. 2 to FIG. 4 inputs air into a furnace 11 in multiple stages to thereby create a reductive atmosphere in the region from a burner section 12 to an additional air input section (hereinafter called an "AA section") 14 and reduce the NOx in the combustion exhaust gas.

Reference numeral 20 of the drawings denotes a solid fuel-fired burner which inputs pulverized coal (pulverized solid fuel) and air, and reference numeral 15 denotes an additional air input nozzle which inputs additional air. For example, as shown in FIG. 2, the solid fuel-fired burner 20 is connected with pulverized coal mixture gas transport pipes 16 which transport the pulverized coal by primary air, and with an air feed duct 17 which supplies secondary air, while the additional air input nozzle 15 is connected with the air feed duct 17 which supplies secondary air.

Thus, the above-described circulating firing boiler 10 adopts a circulating firing system, in which the burner section 12 of the circulating firing system has the solid fuel-fired burner 20 for inputting air and pulverized coal (coal) as a pulverized fuel disposed at each corner of each stage, and one or more circulating flame is formed in each stage.

Figure 1:
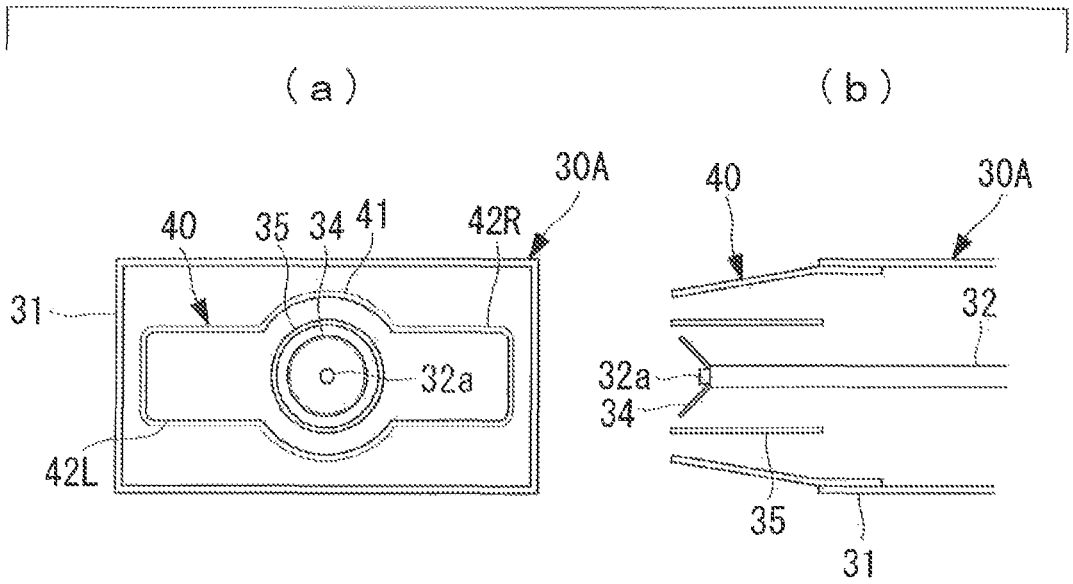
FIG. 1 is a view showing one embodiment of an oil-fired burner according to the present invention.

An oil-fired burner 30A shown in FIG. 1 is a burner for warming which is disposed adjacent to the outer periphery of the pulverized coal burner which is a solid fuel-fired burner for inputting, for example, pulverized coal and air into the furnace.

In the illustrated configuration example, the pulverized coal burner (not shown) is disposed adjacent to the lower side of the oil-fired burner 30A. That is, at the start-up of the circulating firing boiler 10, warming operation of combusting the fuel oil by the oil-fired burner 30A is performed until the temperature inside the boiler including the pulverized coal burner reaches a predetermined temperature. During this warming operation, combustion of pulverized coal by the pulverized coal burner is not performed.

As shown in FIG. 1(*a*), a leading end of a nozzle main body 31 of the oil-fired burner 30A is substantially rectangular when viewed from the inside of the furnace. That is, the nozzle main body of the oil-fired burner 30A is substantially rectangular in longitudinal cross-section, and an oil gun 32 for inputting an oil fuel is disposed in an axial direction at a center position of the outlet opening. A nozzle tip 32*a* for injecting fuel oil having a substantially circular cross-section is mounted at the leading end of the oil gun 32 on the furnace side.

A diffuser 34 is mounted on the leading end side of the oil gun 32 so as to surround the outer periphery of the nozzle tip 32*a*. This diffuser 34 is a member molded from a plate material into a substantially conical shape, and its shape viewed from the inside of the furnace is a circle concentric with the nozzle tip 32*a*.

In addition, a cylindrical ignition air passage 35 is provided on an outer periphery of the diffuser 34 so as to surround the oil gun 32 and the diffuser 34.

A secondary air input port 40 is provided close to the leading end of the oil gun 32 so as to surround (encircle) the outer periphery of the nozzle tip 32*a* installed at the leading end of the oil gun 32, the diffuser 34, and the ignition air passage 35. This secondary air input port 40 is constituted of a central arc section 41, and rectangular sections 42L and 42R provided continuously from left and right ends of the central arc section 41.

Figure 6:
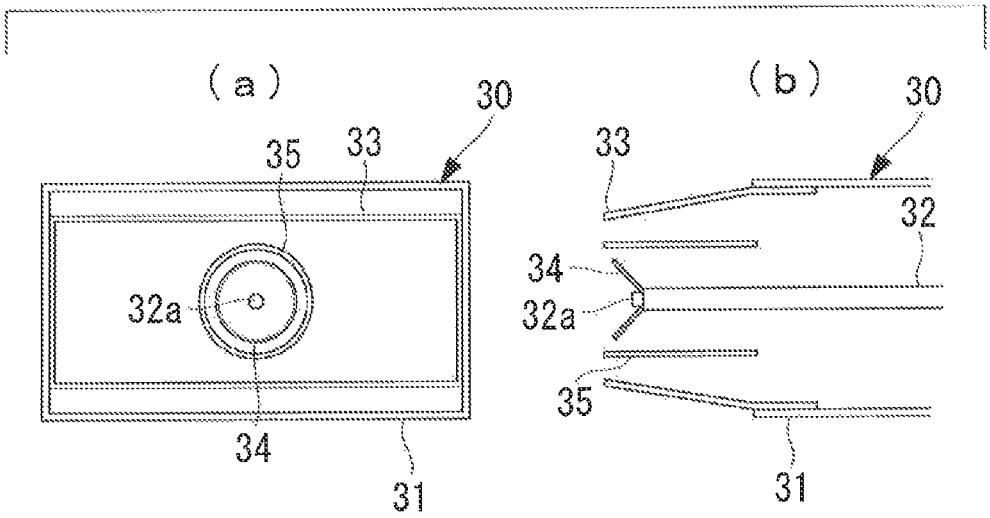
FIG. 6 is a view showing an example of the conventional oil-fired burner.

That is, the central arc section 41 of the secondary air input port 40 is substantially similar in shape to the circular diffuser 34, and the rectangular sections 42L and 42R are provided continuously from both sides of this central arc section 41. The rectangular sections 42L and 42R are narrowed in face-to-face dimension in a vertical direction (in the direction of adjacent pulverized coal burners) so as to increase the distance from the adjacent pulverized coal burners. Thus, compared with the conventional structure shown in FIG. 6, the face-to-face dimension in the vertical direction of the rectangular sections 42L and 42R of the secondary air input port 40 shown in FIG. 1 is narrower. In other words, the secondary air input port 40 shown in FIG. 1 has a face-to-face dimension in the vertical direction of the rectangular sections 42L and 42R reduced from the face-to-face dimension of the rectangular cross-section of the nozzle main body 31, and has an opening shape in which the central arc section 41, which is formed so as to encircle the diffuser 34, bulges out in the vertical direction substantially concentrically with the diffuser 34.

The oil-fired burner 30A thus configured has the secondary air input port 40 constituted of the central arc section 41 which is substantially similar in shape to the circular diffuser 34 mounted at the leading end of the oil gun 32, and the rectangular sections 42L and 42R which are provided continuously from both sides of the central arc section 41 and are narrowed in face-to-face dimension in the direction of the adjacent pulverized coal burners so as to increase the distance from the adjacent pulverized coal burners. Thus, the central arc section 41 of the secondary air input port 40 is formed so as to encircle the circular diffuser 34 from a position relatively closer to the diffuser. That is, compared with the conventional secondary air input port which has a rectangular cross-section as a whole, the secondary air input port 40 is present at a position closer to the end part of the diffuser 34.

For this reason, the secondary air input from the secondary air input port 40 is sufficiently supplied to the diffuser 34 during warming when fuel oil is combusted by the oil-fired burner 30A. That is, since the secondary air supplied to the diffuser 34 is input from the region close to the diffuser 34 of the secondary air input port 40 to the entire periphery of the diffuser, a sufficient amount of air can be secured.

As a result, the oil combustion performance improves and generation of smoke due to insufficient air, etc. is less likely to occur during the warming operation.

On the other hand, since the rectangular sections 42L and 42R of the secondary air input port 40 are narrowed in face-to-face distance in the direction of the adjacent pulverized coal burners so as to increase the distance from the adjacent pulverized coal burners, the secondary air input from this region interferes with the secondary air which is kicked outward by the diffuser 34. As a result, during normal operation after completion of the warming operation, the secondary air input from the space surrounding the diffuser 34 covers the secondary air input from the oil-fired burner 30A so that it does not flow toward the flame of the pulverized coal burner. That is, the secondary air input from the oil-fired burner 30A and guided outward by the diffuser 34 changes its flow direction after collision with the secondary air input from the space surrounding the diffuser 34, so that the amount of secondary air flowing toward the flame of the pulverized coal burner can be reduced.

In addition, since the rectangular sections 42L and 42R of the secondary air input port 40 are at a farther distance from the adjacent pulverized coal burners, the phenomenon of the secondary air being quickly diffused toward the outer periphery of the flame formed by combustion of pulverized coal can be prevented or suppressed.

When the amount of secondary air supplied from the secondary air input port 40 of the oil-fired burner 30A to the pulverized coal flow or the flame of the pulverized coal burner can be thus reduced, creation of the high-temperature oxygen remaining region on the outer periphery of the flame is suppressed, and the amount of NOx generated from the coal-fired boiler can be effectively reduced.

The above-described oil-fired burner 30A is used by being integrated, for example, into a solid fuel-fired burner unit (hereinafter called a "burner unit").

The burner unit includes: a wind box having a vertically long rectangular opening when viewed from the inside of the furnace; one oil-fired burner 30A disposed inside the wind box at the center position in the vertical direction; two pulverized coal burners which are disposed inside the wind box above and below the oil-fired burner 30A and input a pulverized coal flow (pulverized coal and air) into the furnace; and secondary air input ports which are installed inside the wind box at upper and lower ends so as to be located above and below the pulverized coal burners and supply secondary air to each of the pulverized coal burners. The pair of upper and lower secondary air input ports are disposed respectively above the pulverized coal burner on the upper end side inside the wind box and below the pulverized coal burner on the lower end side inside the wind box.

That is, the burner unit is a unit formed of one oil-fired burner 30A, the pair of pulverized coal burners, and the pair of secondary air input ports integrated into the relatively small wind box, and a required number of the burner units are installed inside the furnace in the vertical direction. In this case, an appropriate interval is provided between the burner units adjacent to each other in the vertical direction. As a result, a furnace wall is formed between the burner units.

As described above, the circulating firing boiler 10 of this embodiment has the burner unit, which inputs pulverized coal and air into the furnace, disposed at a corner or on a wall inside the furnace according to a divided wind box system adopted. Thus, compared with the continuous wind box system which involves only one wind box continuous in the vertical direction, the durability and the reliability are improved due to the enhanced strength of the boiler main body. That is, the burner unit of this embodiment allows the configuration of the divided wind box system in which a required number of the burner units are disposed on top of one another according to the boiler specifications, etc., and compared with the configuration of the continuous wind box system, the boiler main body has enhanced strength and is less vulnerable to damage since the furnace wall is present between the burner units in the divided wind box system.

While the above-described burner unit is a unit formed of one oil-fired burner 30A disposed inside the relatively small wind box and the pair of pulverized coal burners and the pair of secondary air input ports integrated above and below the oil-fired burner 30A, the length of the wind box may be extended in the vertical direction, and two or more oil-fired burners 30A and three or more pulverized coal burners may be alternately disposed inside the wind box in the vertical direction so as to form a burner unit.

In this case, the number of the pulverized coal burners is always larger than the number of the oil-fired burners 30A by one, since the oil-fired burner 30A is disposed inside the wind box at the center in the vertical direction and the pulverized coal burner is always present above and below the oil-fired burner 30A. Also in this burner unit, the secondary air input ports which supply secondary air to the pulverized coal burners are disposed at the upper and lower ends inside the wind box so as to be located above and below the pulverized coal burners, that is, disposed respectively above the pulverized coal burner on the upper end side inside the wind box and below the pulverized coal burner on the lower end side inside the wind box.

It is desirable that the secondary air input ports in this case are disposed toward the directions away from each other in the vertical direction. That is, the secondary air input port installed at the upper end of the wind box is at an upward angle from the horizontal direction, and conversely, the secondary air input port installed at the lower end of the wind box is at a downward angle from the horizontal direction.

This way, the secondary air input from the secondary air input ports are input in the directions away from the flame formed by combustion of pulverized coal. Thus, creation of the high-temperature high-oxygen region on the outer periphery of the flame of combusting pulverized coal can be suppressed or prevented, and moreover, the burner unit can be effectively reduced in size.

In addition, the secondary air input ports may be configured in multiple stages in order to increase the vertical distance between the burner units.

It is desirable that the amount of secondary air input from the above-described oil-fired burner 30A, that is, the amount of secondary air supplied from the oil-fired burner 30A to the pulverized coal burners is set to an amount equal to the amount of air input from the secondary air input ports. That is, a half of the secondary air input from the oil-fired burner 30A is supplied to the pulverized coal burner which is located above the oil-fired burner 30A, while the other half of the secondary air is supplied to the pulverized coal burner which is located below the oil-fired burner 30A. Therefore, a substantially equal amount of secondary air is input from above and below the pulverized coal burners to the pair of upper and lower pulverized coal burners.

As described above, according to the oil-fired burner, the solid fuel-fired burner unit, and the solid fuel-fired boiler of this embodiment, the phenomenon of the secondary air input from the oil-fired burner 30A being diffused toward the outer periphery of the flame formed by combustion of pulverized coal, etc. (solid fuel) and being quickly and directly supplied to the outer periphery of the flame can be prevented or suppressed during combustion of the solid fuel such as pulverized coal.

On the other hand, during warming when fuel oil is combusted by the oil-fired burner 30A, the oil combustion performance can be secured by supplying a sufficient amount of air, and generation of smoke due to insufficient air, etc. can be prevented.

Therefore, it is possible to reduce the amount of NOx finally discharged from the solid fuel-fired boiler by adopting the above-described oil-fired burner 30A.

It is intended that the present invention is not limited to the above-described embodiment, but can be appropriately changed within the scope of the present invention.

REFERENCE SIGNS LIST

10 Circulating firing boiler
11 Furnace
12 Burner section
14 Additional air input section (AA section)
20 Solid fuel-fired burner
30, 30A Oil-fired burner
31 Nozzle main body
32 Oil gun
32*a* Nozzle tip
33, 40 Secondary air input port
34 Diffuser
41 Central arc section
42L, 42R Rectangular section

The invention claimed is:

1. An oil-fired burner comprising:

a nozzle main body which is substantially rectangular in cross-section in a view which is orthogonal to an axial direction of the oil-fired burner;

an oil gun for inputting an oil fuel disposed at a center of an outlet opening of the nozzle main body;

a circular diffuser mounted on a leading end side of the oil gun; and a secondary air input port provided so as to surround an outer periphery of the oil gun, wherein the secondary air input port is constituted of:

a central arc section which is substantially similar in shape to the circular diffuser; and rectangular sections which are provided continuously from left and right ends of the central arc section in a horizontal direction and each of which has a face-to-face dimension, between a top face and a bottom face, which is reduced from the face-to-face dimension of a rectangular cross-section of the nozzle main body, wherein the secondary air input port has an opening shape in which the central arc section bulges out in the vertical direction substantially concentrically with the diffuser, and wherein the oil-fired burner is disposed adjacent to an outer periphery of a fuel-fired burner.

2. A fuel-fired burner unit comprising:

a wind box;

at least one oil-fired burner according to claim 1 disposed inside the wind box at a center position in a vertical direction;

fuel-fired burners which are provided in the wind box and which input a fuel and air into a furnace; and secondary air input ports which are installed inside the wind box at upper and lower ends so as to be located above and below the fuel-fired burners and supply secondary air to the fuel-fired burners, wherein the oil-fired burner and the fuel-fired burners are alternately disposed in the vertical direction so that the fuel-fired burners are located above and below the oil-fired burner.

3. A fuel-fired boiler, wherein the fuel-fired burner unit according to claim 2, which inputs a fuel and air into a furnace, is disposed at a corner or on a wall inside the furnace.

* * * * *